US005293660A

United States Patent [19]

Park

[11] Patent Number: 5,293,660

[45] Date of Patent: Mar. 15, 1994

[54] FOOT SCRUB MAT

[76] Inventor: Jai H. Park, 113 Kings's Arms Apt., 1209 S. Charles Blvd., Greenville, N.C. 27858

[21] Appl. No.: 50,831

[22] Filed: Apr. 21, 1993

[51] Int. Cl.[5] ..... A46B 9/02; A47I 23/26

[52] U.S. Cl. ..... 15/160; 15/161; 15/215; 15/217; 4/583; 4/581; 273/195 A; 428/101; 52/177

[58] Field of Search ..... 15/160, 161, 215, 216, 15/217, 112; 273/195 R, 195 A, 187.1, 32 B; 296/97.23; 4/581, 582, 583; 428/92, 99, 101; 52/660, 662, 177, 180, 181, 663

[56] References Cited

U.S. PATENT DOCUMENTS

| | | | |
|---|---|---|---|
| 1,029,802 | 6/1912 | Giclas | 15/112 |
| 1,201,256 | 10/1916 | Clarke | 15/215 |
| 2,512,310 | 6/1950 | Corson | 15/215 |
| 3,100,522 | 8/1963 | McIntyre | 15/215 |
| 3,467,391 | 9/1969 | Elesh | 15/217 |
| 3,808,628 | 5/1974 | Betts | 15/215 |
| 5,215,348 | 6/1993 | Wen-Huang | 296/97.23 |

*Primary Examiner*—Harvey C. Hornsby
*Assistant Examiner*—Gary K. Graham
*Attorney, Agent, or Firm*—Olive & Olive

[57] ABSTRACT

A foot scrub mat which includes a flexible base and a replaceable pad. The flexible base and the replaceable pad are preferably made of an antislip material. The base has an interior cut-out area of selected dimensions. The replaceable pad has a bristled area which has the general dimensions of the cut-out area and which is exposed when the pad is aligned beneath the cut-out area. Preferably the replaceable pad has an exterior rim which lies under the base when the pad is placed beneath and aligned with the cut-out area.

6 Claims, 2 Drawing Sheets

FOOT SCRUB MAT

BACKGROUND OF THE INVENTION

Field of the Invention

The invention relates to mats which are usable in a bath tub or shower.

Description of the Related Art

Rubber or rubber-like bath mats are known for use in bath tubs and showers to keep people from slipping and hurting themselves.

When bathing, particularly when using a shower, it is difficult to wash one's feet thoroughly due to the need to bend, which may be physically difficult and which may increase the danger of falling. Such washing is important due to the prevalence of, and problems associated with, such foot conditions as athlete's foot, diabetic foot ulcers, toenail fungi, and foot odors.

It is therefore an object of this invention to provide a mat which enables the bather's feet to be scrubbed without bending, and provides a non-skid surface upon which the bather may stand.

It is a further object of this invention to provide a mat which is convenient and easy to use for anyone, including the elderly and obese, which does not require assembly, and is inexpensive.

It is a further object of this invention to provide a mat which may be used at in any private or public shower facility, including those in homes, schools, locker rooms, gyms, motels and hotels.

Other objects and advantages will be more fully apparent from the following disclosure and appended claims.

SUMMARY OF THE INVENTION

The invention is a foot scrub mat which comprises a flexible base and a replaceable pad, both of which are preferably made of an antislip material. The flexible base has an interior cut-out area of selected dimensions. The replaceable pad comprises a bristled area which has the general dimensions of the cut-out area and which is exposed when the pad is aligned beneath the cut-out area. Preferably the replaceable pad has an exterior rim which lies under the base when the pad is placed beneath and aligned with the cut-out area.

Other aspects and features of the invention will be more fully apparent from the following disclosure and appended claims.

DETAILED DESCRIPTION OF THE INVENTION AND PREFERRED EMBODIMENTS THEREOF

The present invention is a foot scrub mat, comprising:

(a) a flexible base made of an antislip material and having an interior cut-out area of selected dimensions; and (b) a replaceable pad comprising:

(i) a bristled area which has the general dimensions of the cut-out area and which is exposed when the pad is aligned beneath the cut-out area; and (ii) an exterior rim which lies under the base when the pad is placed beneath and aligned with the cut-out area.

The base most preferably has selected outside dimensions and flexibility so that the base fits on the floor of a shower or in a bath tub, but may also be of a large size if it is to be used in a larger area.

Figure 1:
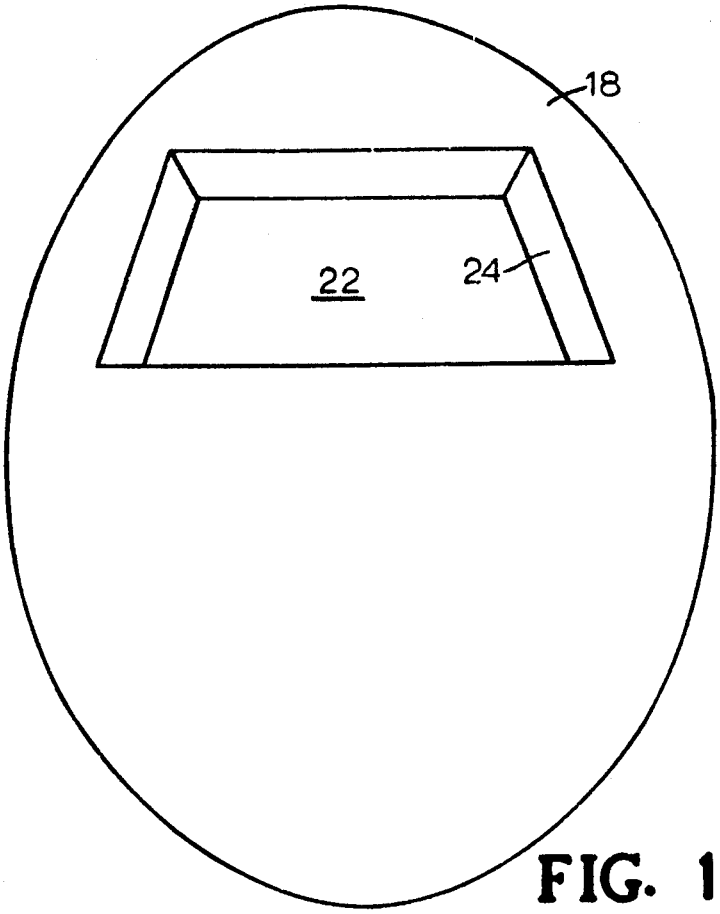
FIG. 1 is a lower perspective view of a flexible base which may be used in the invention.
Figure 2:
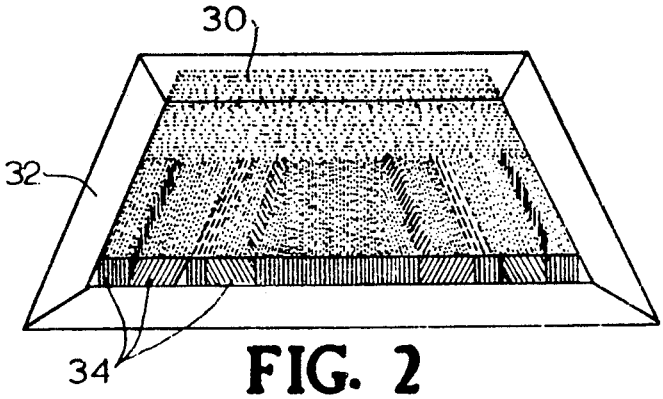
FIG. 2 is an upper perspective view of a replaceable pad which may be used in the flexible base shown in FIG. 1.
Figure 7:
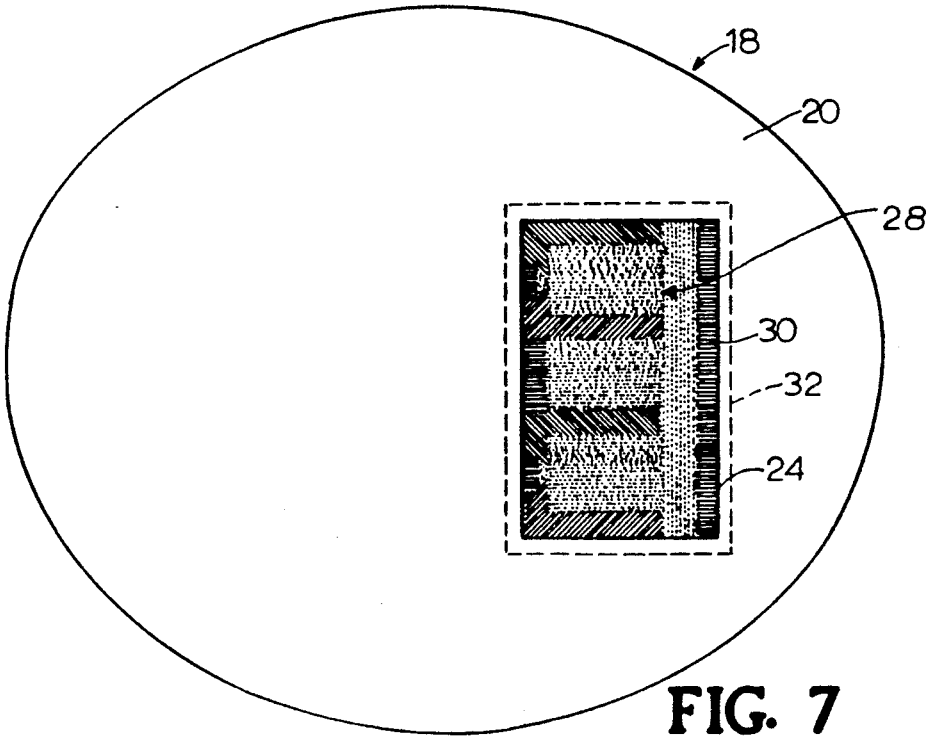
FIG. 7 is a top plan view of the assembled mat of the invention.

Referring now to the Figures, the mat 18 of the invention comprises two primary pieces, a flexible base 20 and a replaceable pad 28 (FIGS. 1,2 and 7). The flexible base 20 is preferably of a size and shape to fit in standard showers and/or bath tubs, but may be made of any greater or smaller size as desired for particular uses. A preferred flexible base 20 is an oval having a length of about 24 inches and a width of about 14 inches.

The flexible base 20 (FIG. 1) has a interior cut-out area 22, which may be located anywhere within the base 20, but preferably is located toward one end of the base 20. Preferably the cut-out area 22 is about 10×7 inches in size.

The replaceable pad 28 (FIG. 2) has a bristled area 30 which has the general dimensions of the cut-out area 22. Surrounding the bristled area 30 is an exterior rim 32. When the pad 28 is placed so that the bristles are exposed and centered in the cut-out area, the exterior rim 30 of the pad 28 is beneath the base 20 around the cut-out area 22. Preferably the edges 24 of the cut-out area 22 and the edge exterior rim 32 of replaceable pad 28 have similarly slanted surfaces as shown (for example, about 45° upward from the edge of replaceable pad 28 toward the bristled area 30 and about the same angle inward around the cut-out area 22 from the bottom of the flexbile base 20 to the top of flexible base 20) so that when base 20 is lifted and replaceable pad 28 is pushed up into cut-out area 22, there is a secure fit between base 20 and replaceable pad 28.

The bristled area 30 preferably comprises a base layer 40 to which the bristles are attached. The bristled area 30 also preferably comprises a plurality of bristled segments 34, each of said bristled segments 34 having all of the bristles in said segment oriented in a selected direction which direction differs between segments 34. As used herein, the terms "inward" and "outward" refer to the direction of slant of the bristles from the base of the bristle where anchored in the pad to the upper tip of the bristles as being toward the central area of the mat ("inward") or toward the closest edge of the mat ("outward"). The length of the bristles may also vary between segments 34. Preferably there are longer bristles about ¾ inch in length, and short bristles about ¼ inch in length. The variations in direction and length of the bristles in the different segments provide for more efficient cleaning when a person uses the bristled area 30 of the pad 28 for foot cleaning.

Figure 6:
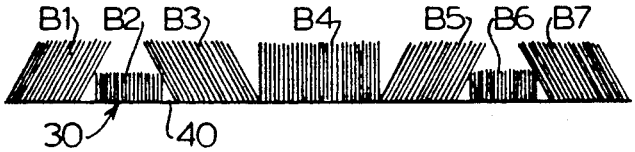
FIG. 6 is a front elevational view of the preferred embodiment of FIG. 4.

In a preferred example of the pad 28, shown in FIGS. 2 and 4–6, there are the following bristled segments 34 (beginning at the top of FIG. 4): (1) an inwardly slanting first row A parallel to a long edge 36 of the bristled area 30; and (2) an area 38 of rows (shown herein as rows B1–B7) perpendicular to said long edge 36. The number of such rows may be altered for different sizes of pads 2. In the preferred embodiment as shown in FIG. 6, the rows comprise in order from left to right, an inwardly slanted row B1, a row of upright short bristles B2, a row of outwardly slanting bristles B3, a row of upright bristles B4, a row of outwardly slanting bristles B5, a row of upright short bristles B6 and an inwardly slanted row B7.

Preferably the first row A is about 2 inches wide and about 10 inches long, and each of the rows B is about 5 inches long. Preferably the width together of rows B1-B2-B3 is about 4 inches, as is the width of the combination of rows B5-B6-B7, while row B4 is about 2 inches wide.

The bristles are attached to the pad 28 by any means known in the art, including any means, for example, as is used for toothbrush or hairbrush bristles, or the bristles may be integrally formed with the pad 28.

Figure 3:
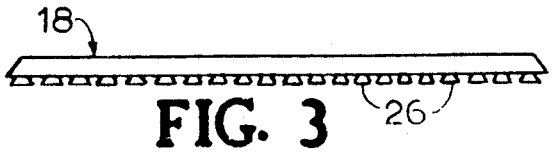
FIG. 3 is an elevational side view of the flexible base of the invention showing the suction devices which are preferably present on both the flexible base and on the replaceable pad.
Figure 4:
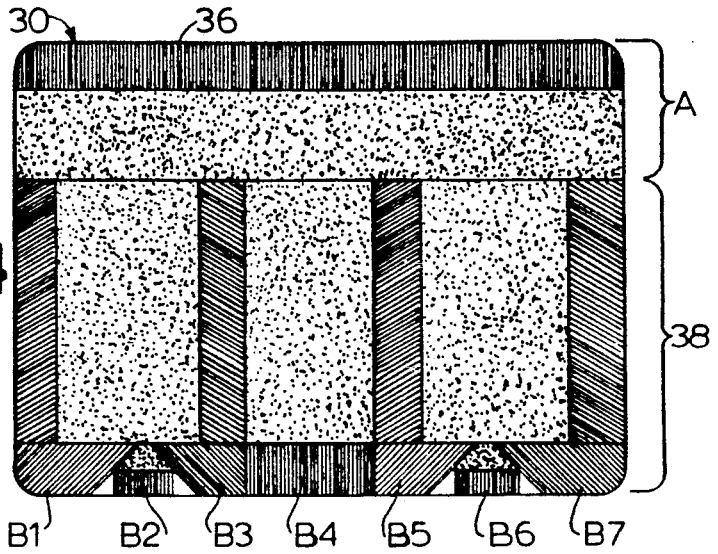
FIG. 4 is a top view of a preferred arrangement of bristles on the replaceable pad of the invention.
Figure 5:
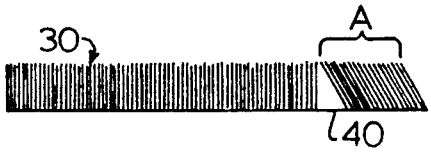
FIG. 5 is a side elevational view of the preferred embodiment of FIG. 4.

Preferably the bottom of the base 20 and the replaceable pad 28 have suction devices 26 as are known in the art for the bottoms of bath mats (FIG. 3).

The flexible base of the invention is placed in the tub or shower and the replaceable pad 2 is placed with the bristled area aligned in the cut-out area. Preferably the replaceable pad 28 is near the drain area of the tub or shower so that soap lather moves over the bristled area 30 before draining out. The assembled mat is used by moving the foot over the bristled area in multiple direction so that the scrubbing action reaches the maximum foot surface when the soap lather reaches the foot and bristled area 30. When a particular pad 28 becomes worn or decreased in usefulness, it may be replaced with a new pad 28.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A foot scrub mat, comprising:

(a) a replaceable pad comprising a bristled area defined by a plurality of bristles attached to a base layer, said base layer having an exterior rim surrounding the bristled area; and (b) a flexible base made of an antislip material, said base having a cut-out area which provides an aperture through said mat to enable said bristled area to be exposed when the replaceable pad is placed beneath the cut-out area; wherein said bristled area has the general dimensions of said cut-out area; wherein when said replaceable pad is placed beneath and aligned with said cut-out area the bristled area is exposed and the exterior rim lies under said base; wherein the bristled area comprises a plurality of bristled segments, each of said bristled segments having all of the bristles in said segment oriented in a selected direction which direction differs between at least two of said segments.

2. A foot scrub mat according to claim 1, wherein the flexible base is generally oval and the cut-out area is rectangular and positioned toward one end of the oval flexible base.

3. A foot scrub mat according to claim 1, wherein said mat has dimensions of about 14×24 inches.

4. A foot scrub mat according to claim 1, wherein said cut-out area has dimensions of about 7×10 inches.

5. A foot scrub mat according to claim 1, wherein said bristles are about ¾ inch in length.

6. A foot scrub mat according to claim 1, wherein said exterior rim is slanted upward from the edge of said replaceable pad toward said bristled area.

* * * * *